US007252871B2

(12) United States Patent
Crkvenac et al.

(10) Patent No.: US 7,252,871 B2
(45) Date of Patent: Aug. 7, 2007

(54) POLISHING PAD HAVING A PRESSURE RELIEF CHANNEL

(75) Inventors: T. Todd Crkvenac, Hockessin, DE (US); Robert T. Gamble, Boothwyn, PA (US); Jason M. Lawhorn, Newark, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 64 days.

(21) Appl. No.: 10/869,657

(22) Filed: Jun. 16, 2004

(65) Prior Publication Data

US 2005/0281983 A1 Dec. 22, 2005

(51) Int. Cl.
*B32B 3/20* (2006.01)
*B24D 11/00* (2006.01)

(52) U.S. Cl. ..... 428/188; 451/527; 451/533

(58) Field of Classification Search ..... 451/527, 451/529, 533, 534; 428/156, 172, 66.6, 188
See application file for complete search history.

(56) References Cited

U.S. PATENT DOCUMENTS 5,605,760 A 2/1997 Roberts
6,884,156 B2 * 4/2005 Prasad et al. ..... 451/533
2002/0115379 A1 * 8/2002 Sevilla et al. ..... 451/6
2003/0171081 A1 * 9/2003 Komukai et al. ..... 451/285

FOREIGN PATENT DOCUMENTS

JP 2003-300150 * 10/2003

OTHER PUBLICATIONS

Webster's II Dictionary, 1984, p. 1321.*

* cited by examiner

*Primary Examiner*—Donald J. Loney
(74) *Attorney, Agent, or Firm*—Edwin Oh; Thomas S. Deibert

(57) ABSTRACT

The present invention provides a chemical mechanical polishing pad comprising a window formed in the polishing pad, the window having a void provided on a side thereof. The polishing pad further comprises a void-pressure relief channel provided in the polishing pad from the void to a periphery of the polishing pad.

11 Claims, 5 Drawing Sheets

POLISHING PAD HAVING A PRESSURE RELIEF CHANNEL

BACKGROUND OF THE INVENTION

The present invention relates to polishing pads for chemical mechanical planarization (CMP), and in particular, relates to polishing pads having reduced stress windows formed therein for performing optical end-point detection. Further, the present invention relates to polishing pads having a pressure relief channel to reduce stress on the windows.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates, such as semiconductor wafers. In conventional CMP, a wafer carrier is mounted on a carrier assembly and positioned in contact with a polishing pad in a CMP apparatus. The carrier assembly provides a controllable pressure to the wafer, pressing it against the polishing pad. The pad is moved (e.g., rotated) relative to the wafer by an external driving force. Simultaneously therewith, a chemical composition ("slurry") or other polishing solution is provided between the wafer and the polishing pad. Thus, the wafer surface is thus polished and made planar by the chemical and mechanical action of the pad surface and slurry.

An important step in planarizing a wafer is determining an end-point to the process. Accordingly, a variety of planarization end-point detection methods have been developed, for example, methods involving optical in-situ measurements of the wafer surface. The optical technique involves providing the polishing pad with a window for select wavelengths of light. A light beam is directed through the window to the wafer surface, where it reflects and passes back through the window to a detector (e.g., a spectrophotometer). Based on the return signal, properties of the wafer surface (e.g., the thickness of films) can be determined for end-point detection.

Roberts, in U.S. Pat. No. 5,605,760, discloses a polishing pad having a window formed therein. In Roberts, a window is cast and inserted into a flowable polishing pad polymer. This polishing pad may be utilized in a stacked configuration (i.e., with a subpad) or used alone, directly adhered on the platen of a polishing apparatus with an adhesive. In either case, there is a "void" or space that is created between the window and the platen. Unfortunately, during polishing, undue stress is applied to the window from the pressure that is generated in the void and may cause unwanted residual stress deformations (e.g., "bulges" or "caving-in") in the window. These stress deformations may result in non-planar windows and cause poor end-point detection, defectivity and wafer slippage.

Hence, what is needed is a polishing pad having a reduced stress window for robust end-point detection or measurement during CMP over a wide range of wavelengths.

STATEMENT OF THE INVENTION

In a first aspect of the present invention, there is provided a chemical mechanical polishing pad comprising: a window formed in the polishing pad, the window having a void provided on a side thereof and a pressure relief channel provided in the polishing pad from the void to a periphery of the polishing pad.

In a second aspect of the present invention, there is provided a chemical mechanical polishing pad comprising: a polishing layer having a window formed therein, the window being exposed to a void on a side thereof and a pressure relief channel provided in the polishing layer from a portion of the void exposed side of the window to a periphery of the polishing layer.

In a third aspect of the present invention, there is provided a chemical mechanical polishing pad comprising: a polishing layer overlying a bottom layer, and an adhesive layer disposed between the polishing layer and the bottom layer; a window formed in the polishing layer, the window being exposed to a void on a side thereof; and a pressure relief channel provided in the adhesive layer from the void to a periphery of the adhesive layer.

In a fourth aspect of the present invention, there is provided a chemical mechanical polishing pad comprising: a polishing layer overlying a bottom layer, and an adhesive layer disposed between the polishing layer and the bottom layer; a window formed in the polishing layer, the window being exposed to a void on a side thereof; and a pressure relief channel provided in the bottom layer from the void to a periphery of the bottom layer.

DETAILED DESCRIPTION OF THE INVENTION

Figure 1:
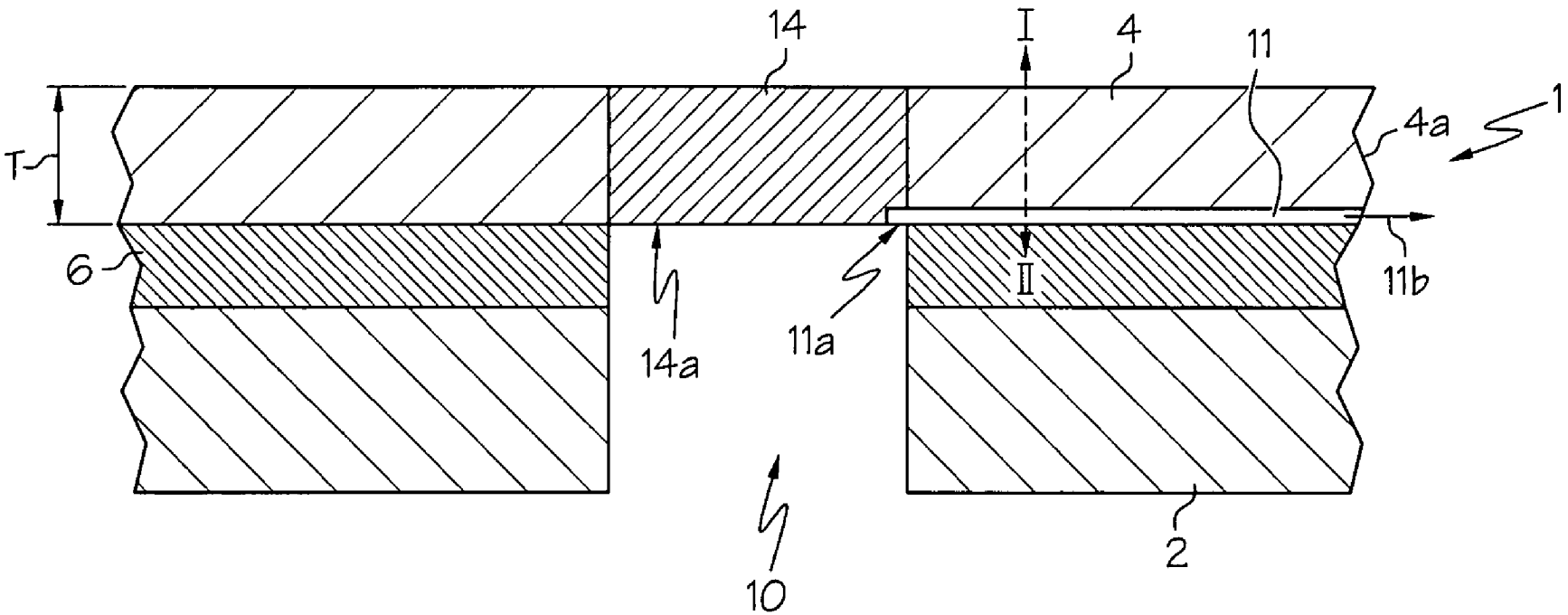
FIG. 1 illustrates a polishing pad having a pressure relief channel of the present invention.

Referring now to FIG. 1, a polishing pad 1 of the present invention is shown. Polishing pad 1 comprises a polishing layer 4 and an optional bottom layer 2. Note, polishing layer 4 and bottom layer 2 may individually serve as a polishing pad. In other words, the present invention may be utilized in the polishing layer 4 alone, or in the polishing layer 4 in conjunction with the bottom layer 2, as a polishing pad. The bottom layer 2 may be made of felted polyurethane, such as SUBA-IV™ pad manufactured by Rohm and Haas Electronic Materials CMP Inc. ("RHEM"), of Newark, Del. The polishing layer 4 may comprise a polyurethane pad (e.g., a pad filled with microspheres), such as, IC 1000™ pad by RHEM. Polishing layer 4 may optionally be texturized as desired. A thin layer of pressure sensitive adhesive 6 may hold the polishing layer 4 and the bottom layer 2 together. The adhesive 6 may be commercially available from 3M Innovative Properties Company of St. Paul, Minn.

Polishing layer 4 has a transparent window 14 provided over the bottom layer 2 and the pressure sensitive adhesive 6. Polishing layer 4 may have a thickness T between 0.70 mm to 2.65 mm. Note, window 14 is provided over the void 10 that creates a pathway for the signal light utilized during end-point detection. Accordingly, laser light from a laser spectrophotometer (not shown) may be directed through the void 10 and transparent window block 14, and onto a wafer or substrate to facilitate end-point detection. Note, although the present invention is described with reference to a polishing pad having an integrally formed window, the invention is not so limited. For example, the entire polishing layer 4 may be transparent ("clear pad") and the void, including pressure, may be created at any point where, for example, the laser spectrophotometer is placed. In other words, the present invention is applicable to a window-less pad. Also, although the present invention is described with respect to end-point detection through a window 14 utilizing a laser spectrophotometer, the invention is not so limited. For example, the polishing layer 4 may be suitably adapted to accommodate other end-point detection methods, for example, measuring the resistance across a polishing surface of the wafer.

In an exemplary embodiment of the invention, polishing pad 1 comprises a pressure relief channel 11 having an inlet 11*a* and an outlet 11*b*. The pressure relief channel 11 extends from a portion of the window 14, on side 14*a* that is exposed to the pressure created in void 10, to a periphery 4*a* of the polishing pad 1, in particular, a periphery 4*a* of the polishing layer 4. Hence, pressure that is generated in the void 10 during the polishing operation may be evacuated through inlet 11*a* and outlet 11*b* of pressure relief channel 11. In other words, any pressure that is generated in void 10 does not materially affect the transparent window 14 since the pressure escapes through the pressure relief channel 11. Therefore, the transparent window 14 is not stressed or deformed due to the pressure build-up and accurate end-pointing is facilitated. Note, although the invention is described here as having a single pressure relief channel, the invention is not so limited. For example, there may be more than one pressure relief channel provided in the polishing layer 4. Alternatively, a single or multiple pressure relief channels may be provided in each of the separate layers (i.e., the adhesive layer and the bottom layer) or any combinations thereof without departing from the scope of the invention. In addition, although the invention is described as having a pressure relief channel that extends to the periphery of the polishing pad, the invention is equally applicable to a polishing pad having a pressure relief channel that extends from the void 10 to the polishing surface of the polishing layer 4. However, particular care must be taken to prevent slurry flow into the channel, for example, by utilizing the capillary action of the pressure relied channel.

Advantageously, the pressure relief channel 11 may be formed by, for example, milling the channel utilizing a computer-numerically controlled tool ("cnc tool"), laser cutting, knife cutting, pre-molding the pad with the channel in place or melting/burning the channel into the pad. Most preferably, the pressure relief channel 11 is formed by milling or laser cutting the channel.

Figure 2A:
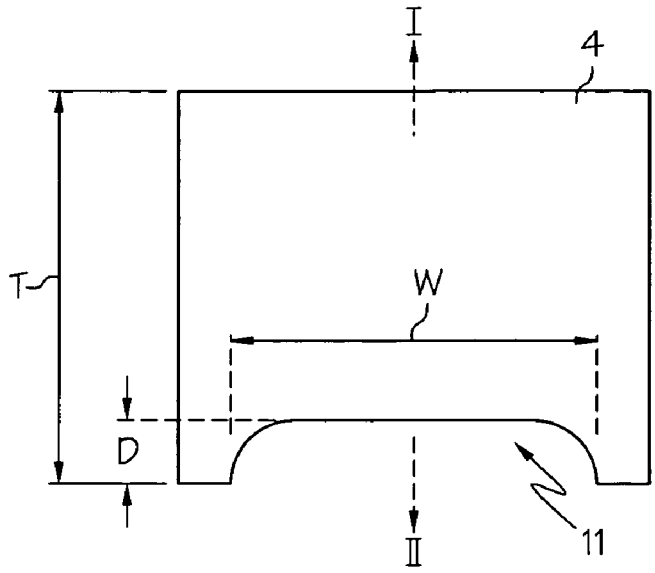
FIG. 2A illustrates a sectional view along line I-II of the polishing pad of FIG. 1.

Referring now to FIG. 2A, a sectional view along line I-II of polishing layer 4 of FIG. 1 is provided. In this embodiment, the pressure relief channel 11 has a semi-circular profile. Note, however, that the particular shape of the profile of the pressure relief channel 11 may be varied without departing from the scope of the invention. For example, the profile of the pressure relief channel 11 may be semi-square or semi-rectangular. In addition, the pressure relief channel 11 has a predetermined width W and depth D. Preferably, the width W is between 0.70 mm to 6.50 mm. More preferably, the width W is between 0.80 mm to 4.00 mm. Most preferably, the width W is between 0.85 mm to 3.50 mm. In addition, the pressure relief channel 11 preferably has a depth D between 0.38 mm to 1.53 mm. More preferably, the depth D is between 0.50 mm to 1.27 mm. Most preferably, the depth D is between 0.55 mm to 0.90 mm. Also, the width W and depth D may be varied along the length of the pressure relief channel 11 to facilitate pressure evacuation. For example, the width W may be narrower near the window 14 as compared to the periphery 4*a*, creating a capillary action to prevent slurry contamination.

Figure 2B:
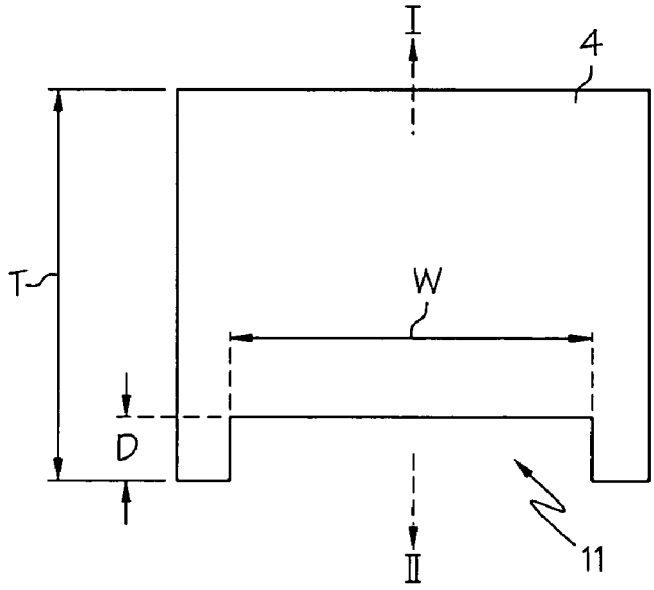
FIG. 2B illustrates another embodiment of a sectional view along line I-II of the polishing pad of FIG. 1.

Referring now to FIG. 2B, an alternative embodiment of the pressure relief channel 11 of the present invention is provided. Similar features as in FIG. 2A are denoted by the same numerals. Here, the profile of the pressure relief channel 11 is semi-rectangular. As discussed above with reference to FIG. 2A, the pressure relief channel 11 has a predetermined width W and depth D. In addition, the width W and depth D may be varied along the length of the pressure relief channel 11 to facilitate pressure evacuation.

Figure 3:
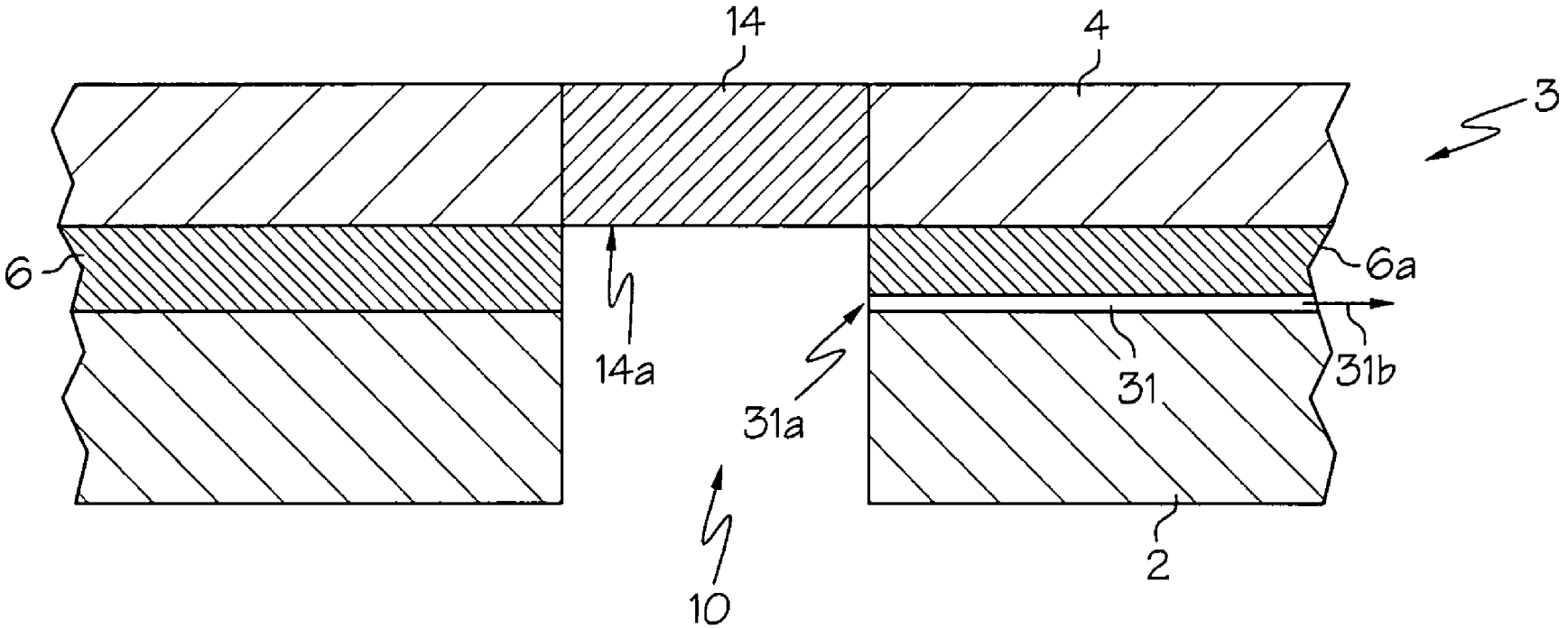
FIG. 3 illustrates another embodiment of a polishing pad having a pressure relief channel of the present invention.

Referring now to FIG. 3, there is provided another embodiment of a polishing pad having a pressure relief channel of the present invention. Similar features as in FIG. 1 are denoted by the same numerals. Here, a polishing pad 3 is provided comprising a pressure relief channel 31, having an inlet 31*a* and an outlet 31*b*, formed in the adhesive 6. The pressure relief channel 31 extends from the void 10, to a periphery 6*a* of the polishing pad 3. More particularly, the pressure relief channel 31 extends from the void 10, to a periphery 6*a* of the adhesive 6. Hence, pressure that is generated in the void 10 during the polishing operation may be evacuated through inlet 31*a* and outlet 31*b* of pressure relief channel 31. In other words, any pressure that is generated in void 10 does not materially affect the transparent window 14 since the pressure escapes through the pressure relief channel 31. Therefore, the transparent window 14 is not stressed or deformed due to the pressure build-up and accurate end-pointing is facilitated, including reduced defectivity and wafer slippage.

Figure 4:
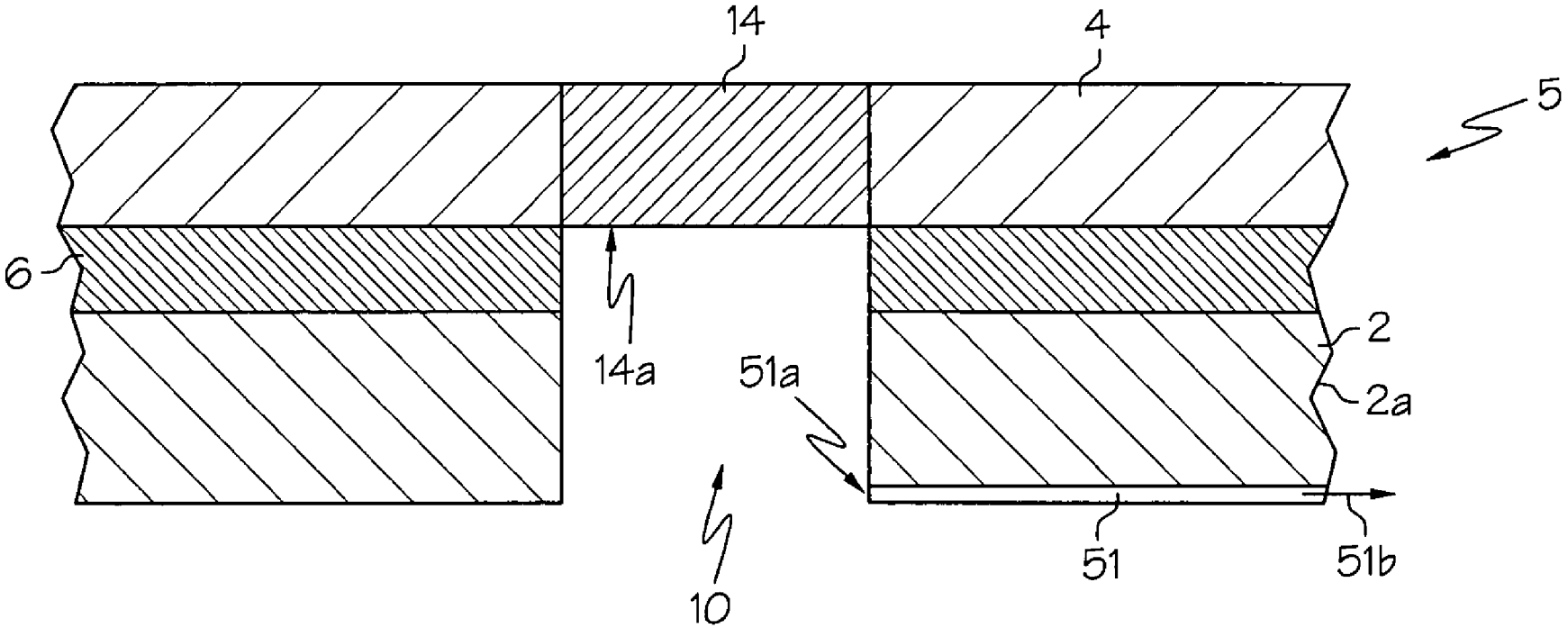
FIG. 4 illustrates another embodiment of a polishing pad having a pressure relief channel of the present invention.

Referring now to FIG. 4, there is provided another embodiment of a polishing pad having a pressure relief channel of the present invention. Similar features as in FIG. 1 are denoted by the same numerals. Here, a polishing pad 5 is provided comprising a pressure relief channel 51, having an inlet 51*a* and an outlet 51*b*, formed in the adhesive 6. The pressure relief channel 51 extends from the void 10, to a periphery 2*a* of the polishing pad 5. More particularly, the pressure relief channel 51 extends from the void 10, to a periphery 2*a* of the bottom layer 2. Hence, pressure that is generated in the void 10 during the polishing operation may be evacuated through inlet 51*a* and outlet 51*b* of pressure relief channel 51. In other words, any pressure that is generated in void 10 does not materially affect the transparent window 14 since the pressure escapes through the pressure relief channel 51. Therefore, the transparent window 14 is not stressed or deformed due to the pressure build-up and accurate end-pointing is facilitated.

Accordingly, the present invention provides a chemical mechanical polishing pad having reduced stress windows. In addition, the present invention provides a chemical mechanical polishing pad comprising, a window formed in the polishing pad, the window having a void provided on a side thereof. The polishing pad further comprises a pressure relief channel provided from the void to a periphery of the polishing pad to relieve undue stress on the window. In addition, the pressure relief channel may be formed in the adhesive layer or the bottom layer. Similarly, one or more pressure relief channels may be formed in the polishing layer, adhesive layer and the bottom layer together or any combination thereof.

Additionally, in an exemplary embodiment of the present invention, the transparent material of window 14 is made from a polyisocyanate-containing material ("prepolymer"). The prepolymer is a reaction product of a polyisocyanate (e.g., diisocyanate) and a hydroxyl-containing material. The polyisocyanate may be aliphatic or aromatic. The prepolymer is then cured with a curing agent. Preferred polyisocyanates include, but are not limited to, methlene bis 4,4' cyclohexylisocyanate, cyclohexyl diisocyanate, isophorone diisocyanate, hexamethylene diisocyanate, propylene-1,2-diisocyanate, tetramethylene-1,4-diisocyanate, 1,6-hexamethylene-diisocyanate, dodecane-1,12-diisocyanate, cyclobutane-1,3-diisocyanate, cyclohexane-1,3-diisocyanate, cyclohexane-1,4-diisocyanate, 1-isocyanato-3,3,5-trimethyl-5-isocyanatomethylcyclohexane, methyl cyclohexylene diisocyanate, triisocyanate of hexamethylene diisocyanate, triisocyanate of 2,4,4-trimethyl-1,6-hexane diisocyanate, uretdione of hexamethylene diisocyanate, ethylene diisocyanate, 2,2,4-trimethylhexamethylene diisocyanate, 2,4,4-trimethylhexamethylene diisocyanate, dicyclohexylmethane diisocyanate, and mixtures thereof. The preferred polyisocyanate is aliphatic. The preferred aliphatic polyisocyanate has less than 14% unreacted isocyanate groups.

Advantageously, the hydroxyl-containing material is a polyol. Exemplary polyols include, but are not limited to, polyether polyols, hydroxy-terminated polybutadiene (including partially/fully hydrogenated derivatives), polyester polyols, polycaprolactone polyols, polycarbonate polyols, and mixtures thereof.

In one preferred embodiment, the polyol includes polyether polyol. Examples include, but are not limited to, polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol, polybutylene adipate glycol, polyethylene propylene adipate glycol, o-phthalate-1,6-hexanediol, poly(hexamethylene adipate) glycol, and mixtures thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, PTMEG-initiated polycaprolactone, and mixtures thereof. The hydrocarbon chain can have saturated or unsaturated bonds, or substituted or unsubstituted aromatic and cyclic groups. Suitable polycarbonates include, but are not limited to, polyphthalate carbonate and poly(hexamethylene carbonate) glycol.

Advantageously, the curing agent is a polydiamine. Preferred polydiamines include, but are not limited to, diethyl toluene diamine ("DETDA"), 3,5-dimethylthio-2,4-toluenediamine and isomers thereof, 3,5-diethyltoluene-2,4-diamine and isomers thereof, such as 3,5-diethyltoluene-2,6-diamine, 4,4'-bis-(sec-butylamino)-diphenylmethane, 1,4-bis-(sec-butylamino)-benzene, 4,4'-methylene-bis-(2-chloroaniline), 4,4'-methylene-bis-(3-chloro-2,6-diethylaniline) ("MCDEA"), polytetramethyleneoxide-di-p-aminobenzoate, N,N'-dialkyldiamino diphenyl methane, p,p'-methylene dianiline ("MDA"), m-phenylenediamine ("MPDA"), methylene-bis 2-chloroaniline ("MBOCA"), 4,4'-methylene-bis-(2-chloroaniline) ("MOCA"), 4,4'-methylene-bis-(2,6-diethylaniline) ("MDEA"), 4,4'-methylene-bis-(2,3-dichloroaniline) ("MDCA"), 4,4'-diamino-3,3'-diethyl-5,5'-dimethyl diphenylmethane, 2,2',3,3'-tetrachloro diamino diphenylmethane, trimethylene glycol di-p-aminobenzoate, and mixtures thereof. Preferably, the curing agent of the present invention includes 3,5-dimethylthio-2,4-toluenediamine and isomers thereof. Suitable polyamine curatives include both primary and secondary amines.

In addition, other curatives such as, a diol, triol, tetraol, or hydroxy-terminated curative may be added to the aforementioned polyurethane composition. Suitable diol, triol, and tetraol groups include ethylene glycol, diethylene glycol, polyethylene glycol, propylene glycol, polypropylene glycol, lower molecular weight polytetramethylene ether glycol, 1,3-bis(2-hydroxyethoxy) benzene, 1,3-bis-[2-(2-hydroxyethoxy) ethoxy]benzene, 1,3-bis-{2-[2-(2-hydroxyethoxy) ethoxy]ethoxy}benzene, 1,4-butanediol, 1,5-pentanediol, 1,6-hexanediol, resorcinol-di-(beta-hydroxyethyl) ether, hydroquinone-di-(beta-hydroxyethyl) ether, and mixtures thereof. Preferred hydroxy-terminated curatives include 1,3-bis(2-hydroxyethoxy) benzene, 1,3-bis-[2-(2-hydroxyethoxy) ethoxy]benzene, 1,3-bis-{2-[2-(2-hydroxyethoxy) ethoxy]ethoxy}benzene, 1,4-butanediol, and mixtures thereof. Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a preferred embodiment of the invention, window 14 may be formed of, for example, polyurethanes, both thermoset and thermoplastic, polycarbonates, polyesters, silicones, polyimides and polysulfone. Example materials for window 14 include, but are not limited to, polyvinyl chloride, polyacrylonitrile, polymethylmethacrylate, polyvinylidene fluoride, polyethylene terephthalate, polyetheretherketone, polyetherketone, polyetherimide, ethylvinyl acetate, polyvinyl butyrate, polyvinyl acetate, acrylonitrile butadiene styrene, fluorinated ethylene propylene and perfluoralkoxy polymers.

Figure 5:
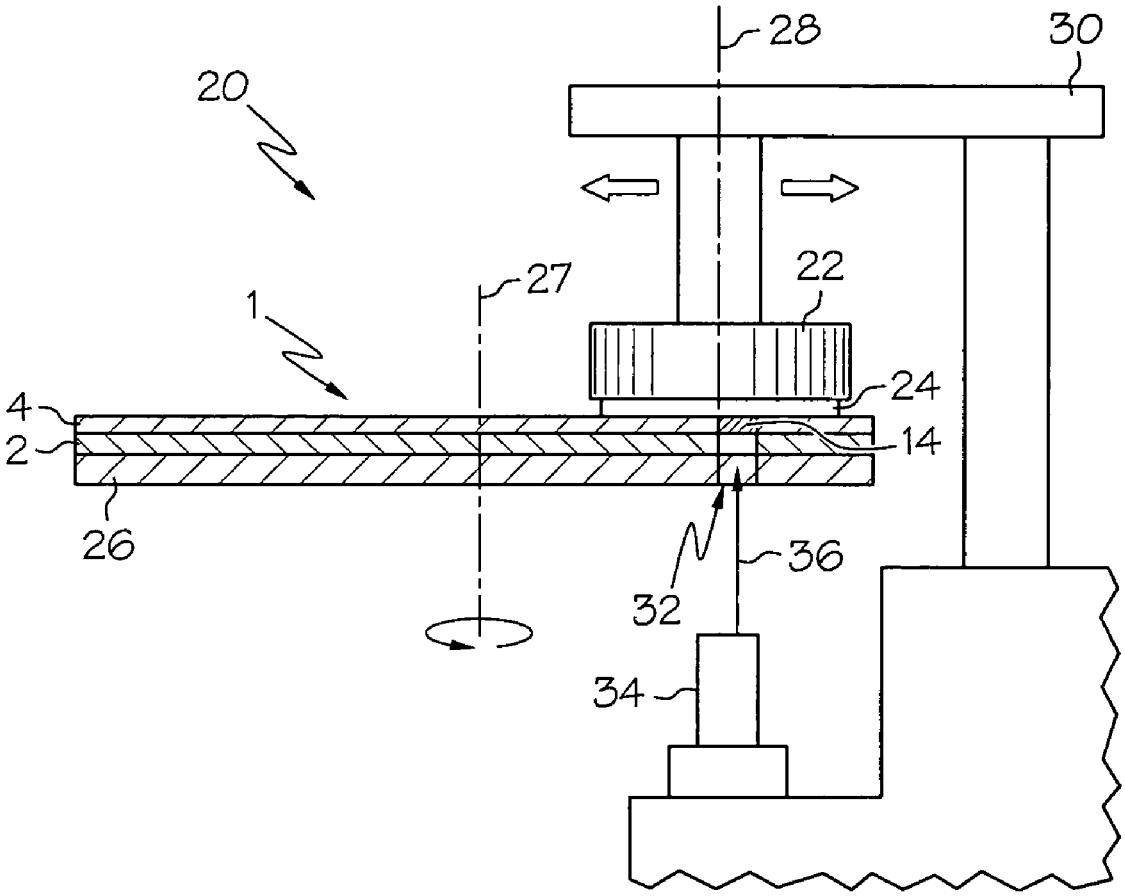
FIG. 5 illustrates a CMP system utilizing the polishing pad of the present invention.

Referring now to FIG. 5, a CMP apparatus 20 utilizing the polishing pad of the present invention, including the pressure relief channel (not shown) is provided. Apparatus 20 includes a wafer carrier 22 for holding or pressing the semiconductor wafer 24 against the polishing platen 26. The polishing platen 26 is provided with pad 1, including window 14 and pressure relief channel 11, of the present invention. As discussed above, pad 1 has a bottom layer 2 that interfaces with the surface of the platen 26, and a polishing layer 4 that is used in conjunction with a chemical polishing slurry to polish the wafer 24. Note, although not pictured, any means for providing a polishing fluid or slurry can be utilized with the present apparatus. The platen 26 is usually rotated about its central axis 27. In addition, the wafer carrier 22 is usually rotated about its central axis 28, and translated across the surface of the platen 26 via a translation arm 30. Note, although a single wafer carrier is shown in FIG. 5, CMP apparatuses may have more than one spaced circumferentially around the polishing platen. In addition, a transparent hole 32 is provided in the platen 26 and overlies the void 10 and the window 14 of pad 1. Accordingly, transparent hole 32 provides access to the surface of the wafer 24, via window 14, during polishing of the wafer 24 for accurate end-point detection. Namely, a laser spectrophotometer 34 is provided below the platen 26 that projects a laser beam 36 to pass and return through the transparent hole 32 and high transmission window 14 for accurate end-point detection during polishing of the wafer 24.

Accordingly, the present invention provides a chemical mechanical polishing pad having reduced stress windows. In addition, the present invention provides a chemical mechanical polishing pad comprising, a window formed in the polishing pad, the window having a void provided on a side thereof. The polishing pad further comprises a pressure relief channel provided from the void to a periphery of the polishing pad to relieve undue stress on the window. In addition, the pressure relief channel may be formed in the adhesive layer or the bottom layer. Similarly, one or more pressure relief channels may be formed in the polishing layer, adhesive layer and the bottom layer together or any combination thereof.

What is claimed is:

1. A chemical mechanical polishing pad comprising:

a polishing layer having a polishing surface and a window block; and a bottom layer having a void;

wherein the polishing layer overlies the bottom layer; wherein the void in the bottom layer underlies the window block on a side of the window block opposite the polishing surface of the polishing layer and a void-pressure relief channel extending from the void to a periphery of the polishing pad; wherein the void-pressure relief channel does not extend to the polishing surface.

2. The polishing pad of claim 1 wherein the void-pressure relief channel is provided in the polishing layer.

3. The polishing pad of claim 1, further comprising an adhesive layer interposed between the polishing layer and the bottom layer, wherein the void-pressure relief channel is provided in the adhesive layer.

4. The polishing pad of claim 1 wherein the void-pressure relief channel is provided in the bottom layer.

5. The polishing pad of claim 1 wherein the void-pressure relief channel has a width between 0.70 mm to 6.50 mm.

6. The polishing pad of claim 5 wherein the width varies between the void to the periphery of the polishing pad.

7. The polishing pad of claim 1 wherein the void-pressure relief channel has a depth between 0.38 mm to 1.53 mm.

8. A chemical mechanical polishing pad comprising:

a polishing layer having a polishing surface and a window block formed therein, and a bottom layer; wherein the polishing layer overlies the bottom layer and wherein the window block is exposed to a void on a side of the polishing layer opposite the polishing surface and a void-pressure relief channel provided in the polishing layer extending from the void exposed side of the window block to a periphery of the polishing layer; and wherein the void-pressure relief channel does not extend to the polishing surface.

9. A chemical mechanical polishing pad comprising:

a polishing layer overlying a bottom layer, and an adhesive layer disposed between the polishing layer and the bottom layer;

a window block formed in the polishing layer, the window block being exposed to a void on a side thereof opposite a polishing surface of the polishing pad;

a void-pressure relief channel provided in the adhesive layer from the void to a periphery of the adhesive layer; and wherein the void-pressure relief channel does not extend to the polishing surface.

10. A chemical mechanical polishing pad comprising:

a polishing layer overlying a bottom layer, and an adhesive layer disposed between the polishing layer and the bottom layer;

a window block formed in the polishing layer, the window block being exposed to a void on a side thereof opposite a polishing surface of the polishing pad;

a void-pressure relief channel provided in the bottom layer from the void to a periphery of the bottom layer;

wherein the void-pressure relief channel does not extend to the polishing surface.

11. The polishing pad of claim 1, further comprising an adhesive layer disposed between the polishing layer and the bottom layer.

* * * * *